United States Patent [19]

Wagatsuma et al.

[11] 4,275,279

[45] Jun. 23, 1981

[54] SWITCH ASSEMBLY HAVING PRINTED CIRCUIT ROTOR AND INTEGRALLY HINGED SPLIT HOUSING

[75] Inventors: Tadashi Wagatsuma; Kenji Hiwatashi, both of Furukawa, Japan

[73] Assignee: Alps Electric Co., Ltd., Tokyo, Japan

[21] Appl. No.: 751,361

[22] Filed: Dec. 16, 1976

[30] Foreign Application Priority Data

Dec. 19, 1975 [JP] Japan ..... 50-171425[U]
Jul. 23, 1976 [JP] Japan ..... 51-98181[U]

[51] Int. Cl.[3] ..... H01H 9/00; H01H 19/54

[52] U.S. Cl. ..... 200/11 DA; 200/11 G; 200/284; 200/302; 200/303

[58] Field of Search ..... 200/11 R, 11 A, 11 D, 200/11 DA, 11 G, 11 J, 11 K, 11 TW, 14, 252, 283, 284, 292, 295, 302, 303

[56] References Cited

U.S. PATENT DOCUMENTS

| | | | |
|---|---|---|---|
| 3,030,460 | 4/1962 | Huetten et al. | 200/11 G |
| 3,366,751 | 1/1968 | Capellari | 200/11 A |
| 3,412,225 | 11/1968 | Rogers et al. | 200/295 X |
| 3,548,131 | 12/1970 | Piber | 200/283 X |
| 3,624,320 | 11/1971 | Eberhart et al. | 200/303 X |
| 3,736,390 | 5/1973 | Lockard | 200/11 DA |

FOREIGN PATENT DOCUMENTS

| | | | |
|---|---|---|---|
| 1170495 | 5/1964 | Fed. Rep. of Germany | 200/11 DA |

*Primary Examiner*—James R. Scott
*Attorney, Agent, or Firm*—Guy W. Shoup; Gerard F. Dunne

[57] ABSTRACT

First and second cover plates are snapped together in parallelism to sealingly define therebetween a switch chamber. First and second sets of contacts are fixed to the first and second cover plates inside the switch chamber and a rotor disc formed with electrically conductive patterns on both sides is rotatably supported inside the switch chamber so that the first and second sets of contacts engage with the patterns on the opposite sides of the rotor disc respectively. The switch contacts are retained by interlocking projections of the first and second cover plates which also serve to prevent transverse relative movement between the cover plates.

13 Claims, 8 Drawing Figures

SWITCH ASSEMBLY HAVING PRINTED CIRCUIT ROTOR AND INTEGRALLY HINGED SPLIT HOUSING

BACKGROUND OF THE INVENTION

The present invention relates to an improved switch assembly.

A known type of rotary switch comprises a stator plate formed with an electrically conductive printed pattern on one side thereof. Terminals are fastened to the stator plate and are connected to the respective portions of the pattern through printed connections which extend from the terminals along the opposite side of the stator plate and through the stator plate to the pattern. A rotor is rotatably supported by the stator plate and carries contacts which bridge the various portions of the printed pattern on the stator plate upon rotation thereof to provide the required switching functions.

This prior art switch has a number of inherent drawbacks which are overcome by the present invention. Due to the basic configuration of the prior art switch, it is difficult to hermetically seal the same for protection against the ingress of dirt and other contaminants. Since the electrically conductive pattern is provided on one side of the stator plate and the printed connections are provided on the opposite side thereof, the number of switching functions is unnecessarily limited. The connection of the terminals to the pattern requires a relatively large number of process steps and the switch is therefore unnecessarily high in cost. Also, the entire stator plate must be redesigned to change the switching functions which limits the interchangeability of parts for physically similar but electrically different switches.

In another type of rotary switch, shown in U.S. Pat. No. 3,736,390 to Lockard and U.S. Pat. No. 3,366,751 to Capellari, a plate is rotatably mounted within a housing. The rotatable plate carries a printed circuit which makes contact with a set of brushes (contacts) which are fixed on the housing. In the Lockhard '390 patent a "flat circular printed circuit board member having a coded circuit etched on one face thereof" may be rotated within the housing and its coded circuit makes contact with brush members 24. In the Capellari '751 patent a rotatable disc may have one printed circuit on one of its sides or two printed circuits on opposite sides of the disc. The disc is rotated so that the printed circuit makes selected contact with stationary contacts carried by flat springs.

SUMMARY OF THE INVENTION

The present invention provides a rotary switch assembly comprising first and second cover plates which are snapped together in parallelism to sealingly define therebetween a switch chamber. First and second sets of contacts are fixed to the first and second cover plates inside the switch chamber and a rotor disc formed with electrically conductive patterns on both sides is rotatably supported inside the switch chamber so that the first and second sets of contacts engage with the patterns on the opposite sides of the rotor disc respectively. The switch contacts are retained by interlocking projections of the first and second cover plates which also serve to prevent transverse relative movement between the cover plates.

It is an object of the present invention to provide a switch assembly of simplified construction which is hermetically sealed, small and compact.

It is another object of the present invention to provide a switch assembly in which the number of individual switch terminals is doubled over the prior art switch described hereinabove.

It is another object of the present invention to provide a switch assembly in which printed interconnections between terminals and electrically conductive patterns are eliminated.

It is another object of the present invention to provide a switch assembly which is more reliable than prior art switch assemblies due to protection from dirt and other contaminants.

It is another object of the present invention to provide a switch assembly in which modification of the switching function may be performed by simply redesigning the electrically conductive patterns on a rotor disc.

It is another object of the present invention to provide a switch assembly in which interchangeability of parts for physically similar but electrically different switches is maximized.

It is another object of the present invention to provide a switch assembly which is simpler in construction and easier and cheaper to commercially manufacture than prior art switch assemblies of comparable type.

It is another object of the present invention to provide a generally improved rotary switch assembly.

Other objects, together with the foregoing, are attained in the embodiments described in the following description and illustrated in the accompanying drawings.

DESCRIPTION OF THE PREFERRED EMBODIMENTS

While the rotary switch assembly of the invention is susceptible of numerous physical embodiments, depending upon the environment and requirements of use, substantial numbers of the herein shown and described embodiments have been made, tested and used, and all have performed in an eminently satisfactory manner.

Figure 1:
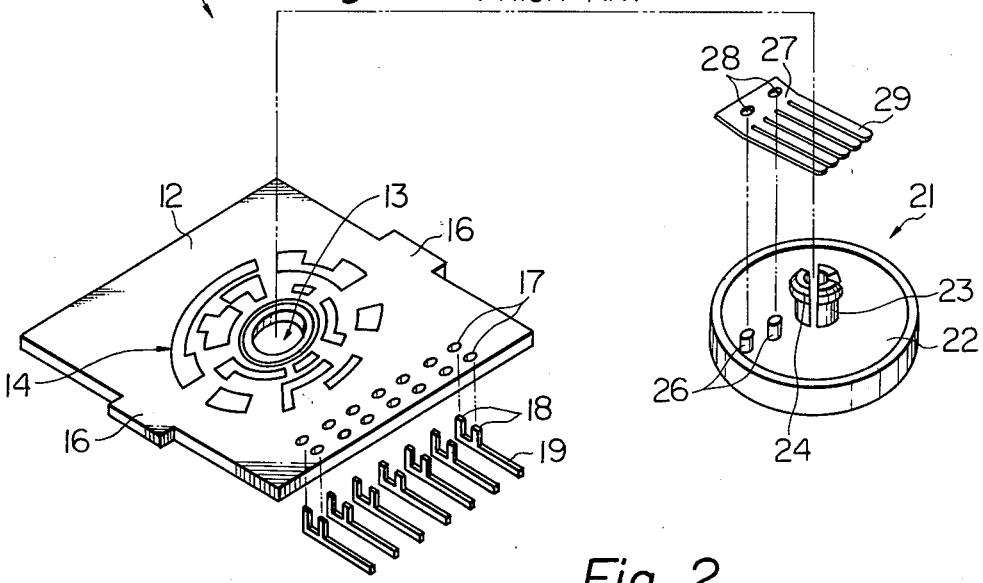
Fig. 1 PRIOR ART
FIG. 1 is an exploded perspective view of a prior art rotary switch assembly.

Referring now to FIG. 1 of the drawing, a prior art switch assembly 11 comprises a stator plate 12 made of an electrically insulative material such as epoxy. The stator plate 12 is formed with a central through hole 13 and an electrically conductive printed switch pattern 14 on its upper surface. Tabs 16 facilitate the mounting of the stator plate 12 to a switch frame (not shown). The stator plate 12 is further formed with a plurality of pairs of holes 17, only one pair being labeled in the drawing for simplicity of illustration, into which fittingly extend respective pairs of prongs 18 of terminals 19. Although not visible in the drawing, the lower surface of the stator plate 12 is formed with electrically conductive printed connections which extend along the lower surface of the stator plate 12 from the terminals 19 and upwardly through the stator plate 12 to the printed switch pattern 14. After insertion of the prongs 18 into the holes 17, the terminals 19 are soldered to the printed connections.

A rotor 21 is formed with a rotor body or disc 22 and a central hub or shaft 23. The shaft 23 is tubular, resilient, and is formed with three axial grooves which split the shaft 23 into three sections (not designated). In addition, an annular lip 24 is formed at the end of the shaft 23. The rotor disc 22 is further formed with two pins 26 which are radially spaced from the shaft 23.

A contact member 27 is formed with two holes 28 into which the pins 26 extend to fixedly mount the contact member 27 to the rotor disc 22. The contact member 27 is electrically conductive and is pectinated in such a manner as to comprise resilient contact arms 29 in a number equal to the radial segments (not designated) of the pattern 14, only one of the arms 29 being labeled in the drawing. After the contact member 27 is fitted onto the rotor disc 22, the pins 26 are peened over the contact member 27 to rigidly fix the same to the rotor disc 22.

The shaft 23 of the rotor disc 22 is then passed through the hole 13 of the stator plate 12 from above so that the assembly of the rotor disc 22 and the contact member 27 is rotatably mounted on the stator plate 12. The outer diameter of the shaft 23 proper is substantially the same as the diameter of the hole 13. However, the lip 24 is larger in diameter than the hole 13. As the shaft 23 is passed through the hole 13, it is resiliently deformed inwardly allowing the lip 24 to pass through the hole 13. As the lip 24 clears the hole 13, the shaft 23 will resiliently return to its original shape. With the lip 24 oriented below the lower surface of the stator plate 12, the rotor disc 22 is prevented thereby from detachment from the stator plate 12.

Although not shown in the drawing, a rotor drive shaft extends through the bore of the rotor shaft 23 for integral rotation with the rotor shaft 23 and a suitable detent mechanism is provided to the rotor drive shaft. In the various detent positions of the rotor drive shaft and thereby the rotor disc 22, the arms 29 of the contact member 27 ohmically engage with the various segments of the pattern 14 so that electrically conductive paths are established between selected terminals 19 through the printed connections, pattern 14 and contact member 27. The arrangement of the pattern 14 determines the switching functions of the switch 11.

The prior art switch assembly 11 suffers from the drawbacks enumerated above in that it is not easily hermetically sealed, it is complicated and therefore expensive to manufacture and the switching functions may not be easily changed.

Figure 2:
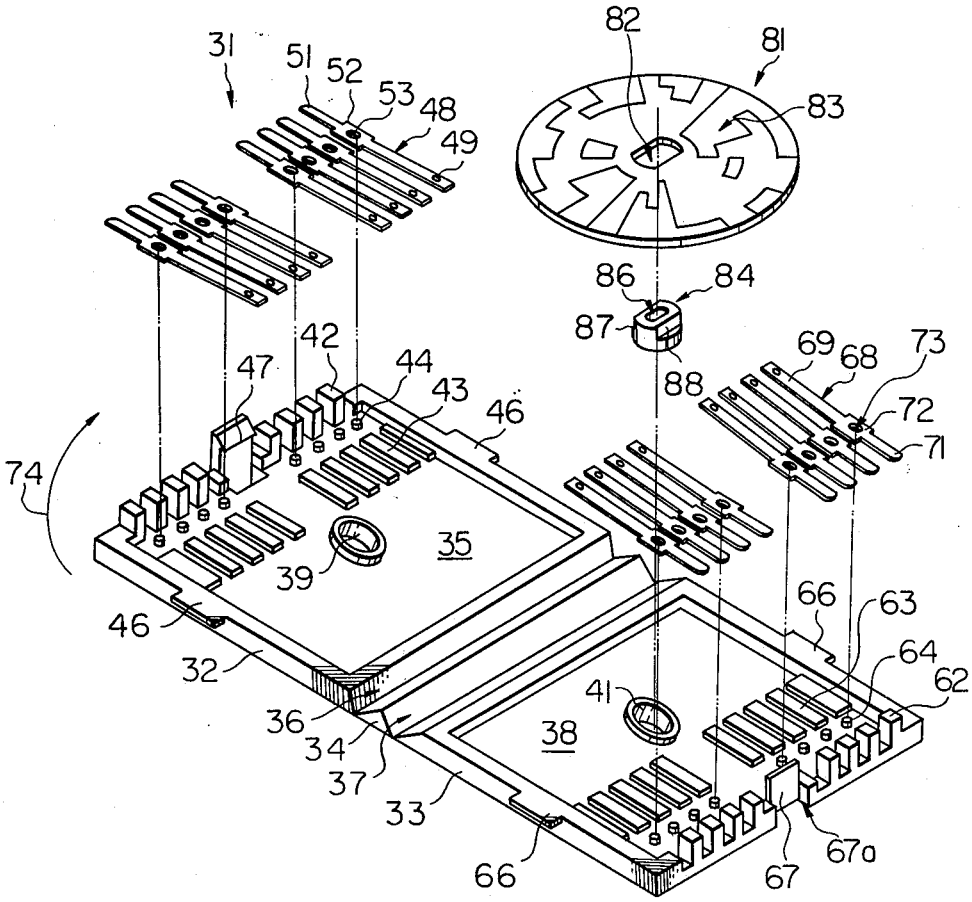
FIG. 2 is an exploded perspective view of a rotary switch assembly embodying the present invention.
Figure 3:
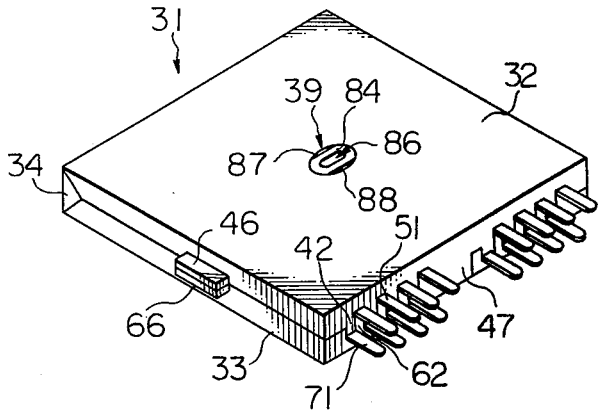
FIG. 3 is a perspective view showing the appearance of the rotary switch assembly of FIG. 2 assembled.

These drawbacks are overcome in a rotary switch assembly 31 of the present invention which is shown in FIGS. 2 and 3. The switch assembly 31 comprises two integral cover plates 32 and 33 formed of an electrically insulative material such as plastic. The cover plates 32 and 33 are rectangular in shape and are hingably joined by a resilient connecting portion 34 which is formed with two transverse equilateral triangular grooves 36 and 37. The cover plates 32 and 33 are furthermore formed with rectangular recesses 35 and 38 which cooperate to define a switch chamber (not designated) when the cover plates 32 and 33 are fitted together in parallelism. The cover plates 32 and 33 are further formed with central through holes 39 and 41 respectively.

The cover plate 32 is formed with a plurality of transversely spaced rectangular projections 42, only one being labeled, which extend perpendicularly upwardly from the leftmost edge of the cover plate 32 as viewed in FIG. 2. Longitudinal slats or grooves 43, only one being labeled, are also formed on the cover plate 32 in the same number as the projections 42 and are transversely aligned therewith respectively. The cover plate 32 is further formed with pins 44 extending perpendicularly upwardly from the cover plate 32 between the projections 42 and the grooves 43. However, rather than being transversely aligned with the projections 42, the pins 44 are transversely aligned with the centers of the spaces between the projections 42.

The cover plate 32 is further formed with tabs 46 for mounting to a frame (not shown) and a snap member in the form of a resilient hook 47 which extends perpendicularly upwardly from the left edge of the cover plate 32.

A plurality of electrically conductive contacts 48 are provided, only one being labeled, which correspond in number to the number of spaces between the projections 42. Each contact 48 is integrally formed with a contact portion 49, a terminal portion 51, a mounting portion 52 and a hole 53 formed through the mounting portion 52. The contacts 48 are fitted into the spaces between adjacent projections 42 and grooves 43 so that the pins 44 extend through the respective holes 53. Thereafter, the pins 53 are peened over the mounting portions 52 to firmly mount the contacts 48 to the cover plate 32. The contacts 48 extend longitudinally in parallel, are prevented from longitudinal movement by the pins 44 and are prevented from transverse movement and rotation about the pins 44 by the projections 42 and grooves 43.

The cover plate 33 is formed with a plurality of transversely spaced rectangular projections 62, only one being labeled, which extend perpendicularly upwardly from the rightmost edge of the cover plate 33 as viewed in FIG. 2. Longitudinal slats or grooves 63, only one being labeled, are also formed on the cover plate 33 in the same number as the projections 62, and are transversely aligned therewith respectively. The cover plate 33 is further formed with pins 64 extending perpendicularly upwardly from the cover plate 33 between the projections 62 and the grooves 63. However, rather than being transversely aligned with the projections 62, the pins 64 are transversely aligned with the centers of the spaces between the projections 62.

The cover plate 63 is further formed with tabs 66 for mounting to the frame, and a snap member in the form of a projection 67 which extends perpendicularly upwardly from the right edge of the cover plate 33. The lower end of the projection 67 is cut out as indicated at **67*a* in a configuration conjugate to the end of the hook 47**.

A plurality of electrically conductive contacts 68 are provided, only one being labeled, which correspond in number to the number of spaces between the projections 62. Each contact 68 is integrally formed with a contact portion 69, a terminal portion 71, a mounting portion 72 and a hole 73 formed through the mounting portion 72. The contacts 68 are fitted into the spaces between adjacent projections 62 and grooves 63 so that the pins 64 extend through the respective holes 73. Thereafter, the pins 73 are peened over the mounting portions 72 to firmly mount the contacts 68 to the cover plate 33. The contacts 68 extend longitudinally and in parallel, are prevented from longitudinal movement by the pins 64 and are prevented from transverse movement and rotation about the pins 64 by the projections 62 and grooves 63.

The projections 42 and 62 are alternately transversely spaced in such a manner that the projections 42 fit between adjacent projections 62 when the cover plate 32 is rotated or folded in the direction of an arrow 74 into abutting parallel engagement with the cover plate 33. The projections 42 and 62 interlock to aid in retaining the contacts 48 and 68 and prevent relative transverse movement between the cover plates 32 and 33. As viewed in FIG. 3, with the cover plates 32 and 33 folded together in conjugate parallelism, the contacts 48 are disposed above the contacts 68 and are alternately transversely spaced therefrom. In addition, the terminals 49 and 69 extend external of the cover plates 32 and 33 in the same direction.

The ends of the projections 42 engage the contacts 68 and the ends of the projections 62 engages the contacts 48 to firmly press the same against the cover plates 33 and 32 respectively. The grooves 36 and 37 of the connecting portion 34, due to their equilateral triangular shape, ensure that the cover plates 32 and 33 will mate in perfect parallelism. For this reason, the contacts 48 and 68 are substantially sealingly enclosed between the cover plates 32 and 33 thereby preventing the ingress of dirt and other contaminants into the switch chamber.

A rotor disc 81 is formed with a central generally rectangular central hole 82 and an electrically conductive printed switch pattern 83 on the upper surface thereof. Although not visible in the drawing, another electrically conductive printed switch pattern is formed on the lower surface of the rotor disc 81. A rotor shaft 84 having an outer diameter substantially equal to the diameter of the holes 39 and 41 is formed with a generally rectangular bore 86 and is cut away as indicated at 87 and 88 to form a generally rectangular upper end portion which is conjugate to the hole 82 in the rotor disc 81. The rotor disc 81 is fitted onto the upper end of the rotor shaft 84 to be integrally rotatable therewith.

With the various components of the switch assembly 11 in the orientation shown in FIG. 2, the lower end of the rotor shaft 84 is inserted into the hole 41 and the cover plate 32 is rotated or folded relative to the cover plate 33 as designated by the arrow 74 so that the upper end of the rotor shaft 84 engages in the hole 39. The hook 47 is resiliently deformed outwardly so as to ride over the projection 67 until the end of the hook 47 snaps into the cutout 67*a* thereby snappingly locking the cover plates 32 and 33 together.

In the assembled condition shown in FIG. 3, the contacts 48 ohmically engage with the pattern 83 on the upper surface of the rotor disc 81 and the contacts 68 ohmically engage with the pattern on the lower surface of the rotor disc 81. Upon rotation of the rotor disc 81 the pattern 83 provides electrically conductive paths between selected contacts 48 depending on the rotational position of the rotor disc 81 and the arrangement of the pattern 83. Although not shown, a rotor drive shaft having an end with a rectangular cross section which fits into the bore 86 of the rotor shaft 84 and a detent mechanism for the rotor drive shaft are provided so that rotation of the rotor drive shaft causes stepwise rotation of the rotor disc 81.

In the same manner, electrically conductive paths are established through the pattern on the back of the rotor disc 81 between selected contacts 68 depending on the rotational position of the rotor disc 81 and the arrangement of the pattern. Although the patterns on the opposite sides of the rotor disc 81 are independent in the embodiment shown and described heretofore so that the contacts 48 and the pattern 83 constitute a first switch and the contacts 68 and the pattern on the lower surface of the rotor disc 81 constitute a second switch which is electrically independent of the first switch, the patterns may be interconnected through the rotor disc 81 to provide a more complicated cooperative switching function.

Figure 4:
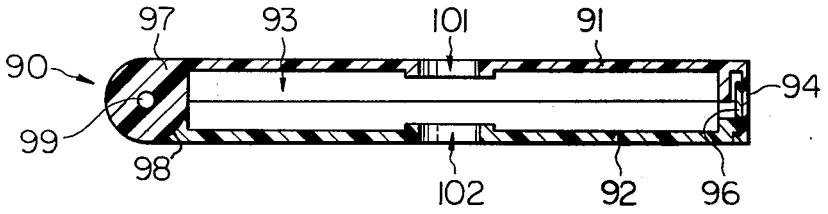
FIGS. 4 and 5 are longitudinal sectional views illustrating modifications of the switch assembly of FIG. 2.

Various modifications to the switch assembly 31 are illustrated in FIGS. 4 to 8. Whereas in the assembly 31 the cover plates 32 and 33 are formed integrally and hinged together by the connecting portion 34, FIG. 4 shows how cover plates 91 and 92 may be formed separately and joined together to define therebetween a switch chamber 93 of a switch assembly 90 which is shown only partially. The cover plates 91 and 92 are snapped together at their right ends as viewed in FIG. 4 by a hook 94 identical to the hook 47 extending from the cover plate 91 and a projection 96 identical to the projection 67 extending from the cover plate 92. The left ends of the cover plates 91 and 92 are hinged together by at least one hinge projection 97 extending from the cover plate 91 and at least one hinge projection 98 extending from the cover plate 92. A hinge pin 99 passes through the hinge projections 97 and 98 to hingably connect the cover plates 91 and 92 together. Also shown in FIG. 4 are through holes 101 and 102 formed through the cover plates 91 and 92 respectively for the rotor shaft 84.

Figure 5:
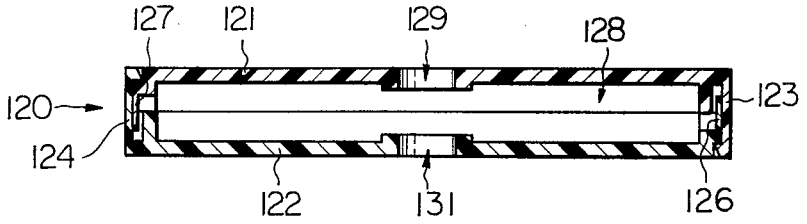
Figure 6:
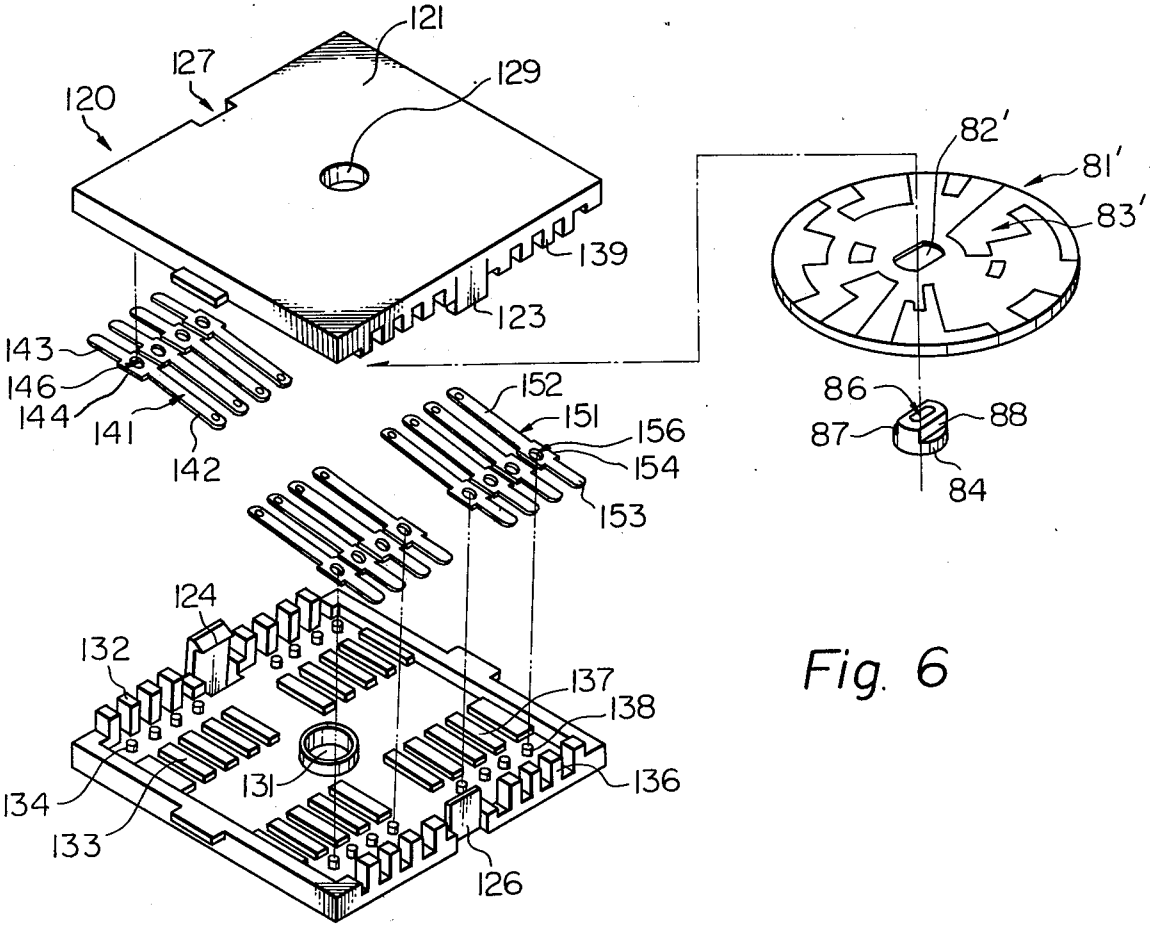
FIG. 6 is an exploded perspective view of another embodiment of a rotary switch assembly according to the present invention.
Figure 7:
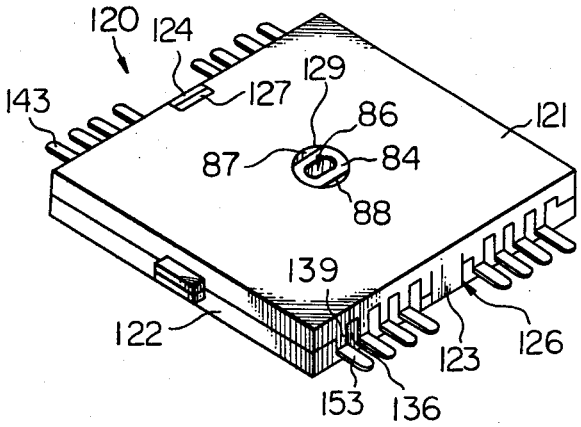
FIG. 7 is a perspective view showing the appearance of the switch assembly of FIG. 6 assembled.

FIG. 5 shows another switch assembly 120 in which cover plates 121 and 122 are snappingly connected together at both ends. Specifically, hooks 123 and 124 identical to the hook 47 extend from the cover plates 121 and 122 respectively and snappingly interlock with projections 126 and 127 which extend from the cover plates 122 and 121 respectively. The cover plates 121 and 122 define a switch chamber 128 therebetween and are formed with through holes 129 and 131 to accept the rotor shaft 84 as shown in FIG. 6. A rotor disc 81' has suitably modified switch patterns but otherwise is similar to the rotor disc 81. Corresponding elements are designated by the same reference numerals primed.

In the switch assembly 120, the cover plates 121 and 122 are identical. The cover plate 122 is formed with projections 132, grooves 133 and pins 134 which are identical to the projections 42, grooves 43 and pins 44 respectively. The cover plate 122 is further formed with projections 136, grooves 137 and pins 138 which are identical to the projections 62, grooves 63 and pins 64 respectively. The cover plate 121 is formed with projections 139 identical to the projections 132 and other projections, grooves and pins which are not visible in the drawing but correspond exactly to those of the cover plate 122.

Contacts 141 formed with contact portions 142, terminal portions 143, mounting portions 144 and holes 146 are fixed to the cover plate 121 in the same manner as in the switch assembly 31. Contacts 151 having contact portions 152, terminal portions 153, mounting portions 154 and holes 156 are similarly mounted to the cover plate 122. As viewed in FIG. 7, the contacts 141 and 151 extend externally from the cover plates 121 and 122 in opposite directions. The terminals 141 ohmically engage with the pattern 83' of the rotor disc 81' and the terminals 151 ohmically engage with the pattern on the lower surface of the rotor disc 81'.

Figure 8:
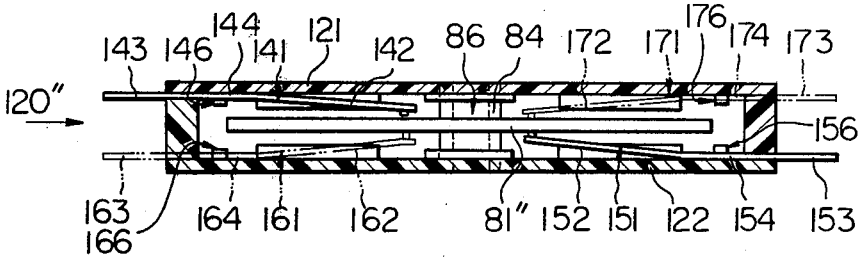
FIG. 8 is a longitudinal sectional view illustrating a modification of the switch assembly of FIG. 7.

FIG. 8 illustrates a modification of the switch assembly 120 in which corresponding elements are designated by the same reference numerals double primed. The switch assembly 120'' is the same as the switch assembly 120 except that additional contacts 161 having contact portions 162, terminal portions 163, mounting portions 164 and holes 166 are provided below the contacts 141 and contacts 171 having contact portions 172, terminal portions 173, mounting portions 174 and holes 176 are provided above the contacts 151. The contacts 141 and 171 ohmically engage with the pattern 83'' and the contacts 161 and 151 ohmically engage with the pattern on the lower surface of the rotor disc 81'', the patterns being suitably modified.

In summary, it will be seen that the present invention provides a switch assembly which is thin and compact in construction, hermetically sealed, simpler and less expensive to commercially produce and provides at least twice the number of switching functions compared to prior art switch assemblies.

In addition, the switching functions may be changed by simply replacing the rotor disc with another rotor disc which is formed with patterns corresponding to the new switching functions. Many modifications will become possible for those skilled in the art after receiving the teachings of the present disclosure without departing from the scope thereof.

What is claimed is:

1. A switch assembly comprising:

a first electrically insulative housing member having a hole therethrough;

first means for retaining a plurality of contacts in spaced relation on said first housing member, said first retaining means including a plurality of first projections extending outwardly from an edge portion of said first housing member and spaced from one another;

a second electrically insulative housing member adapted to fit in parallel relation with said first housing member;

second means for retaining a plurality of contacts in spaced relation on said second housing member, said second retaining means including a plurality of second projections extending outwardly from an edge portion of said second housing member and spaced from one another, said second projections being offset from said first projections so as to interfit therewith;

a plurality of longitudinally extending first electrical contacts retained by said first retaining means, each of said first contacts lying between respective first projections with one of the second projections interfitting therebetween;

a plurality of longitudinally extending second electrical contacts retained by said second retaining means, each of said contacts lying between respective second projections with one of the first projections interfitting therebetween;

a rotor shaft rotatably extending through said hole;

a rotor disc mounted on the rotor shaft for rotation therewith, said disc having first and second electrically conductive patterns formed on opposite sides thereof, respectively; and means for fastening the first and second housing members together in parallel relation with the rotor disc disposed between said first and second contacts so that said first contacts operatively engage said first pattern and said second contacts operative engage said second pattern, in which the first and second cover plates are configured to be complementary interfitting so as to substantially sealingly enclose the first and second contacts and the rotor disc.

2. A switch assembly as in claim 1 in which the first and second contacts each extend externally from a common side of said switch assembly.

3. A switch assembly as in claim 1, in which each of the first and second contacts is formed with a hole therethrough, the first retaining means further comprising a plurality of pins extending through the holes of the first contacts respectively and the second retaining means further comprising a plurality of pins extending through the holes of the second contacts respectively to prevent rotation thereof.

4. A switch assembly as in claim 1, in which the fastening means comprises hinge means connecting a first edge of the first cover plate to a second edge of the second cover plate.

5. A switch assembly as in claim 4, in which the first and second cover plates are integrally formed, the first and second edges thereof being connected together by the hinge means.

6. A switch assembly as in claim 5, in which the hinge means comprises a resilient connecting member.

7. A switch assembly as in claim 6, in which the connecting member is formed with two equilateral triangular transversely extending grooves.

8. A switch assembly as in claim 4, in which the hinge means comprises first and second hinge projections extending from the first and second edges respectively and a hinge pin rotatably extending through the first and second hinge projections.

9. A switch assembly as in claim 4, in which the fastening means further comprises snap means connecting together third and fourth edges of the first and second cover plates which are opposite to the first and second edges thereof respectively.

10. A switch assembly as in claim 1, the interfitting of said first and second projections serving to prevent relative transverse movement between said first and second cover plates.

11. A switch assembly as in claim 1, said first retaining means including and plurality of first projections extending, respectively, perpendicularly from opposite edge portions of said first cover plate;

said second retaining means including a plurality of second projections extending respectively, perpendicularly from opposite edge portions of said second cover plate; and said first and second contacts extending externally from opposite sides of said switch assembly.

12. A switch assembly as in claim 1, said fastening means comprising a first resilient member extending integrally from a first edge of said first cover plate;

a second resilient member extending integrally from a second edge of said first cover plate;

a third resilient member extending integrally from a first edge of said first cover plate and adapted to interlock with said first resilient member; and a fourth resilient member extending integrally from a second edge of said second cover plate and adapted to interlock with said second resilient member, whereby said first resilient member will interlock with said third resilient member, and said second resilient member will interlock with said fourth resilient member when said resilient members are aligned and pressed together.

13. A switch assembly as in claim 12 in which the first and second cover plates are identical.

* * * * *